United States Patent [19]

Consigny

[11] Patent Number: 4,507,804

[45] Date of Patent: Apr. 2, 1985

[54] FINGER-GUARD

[76] Inventor: Claude Consigny, 4160 - 3rd Ave. - Apartment 16, Charlesbourg, Quebec G1H 6E1, Canada

[21] Appl. No.: 555,598

[22] Filed: Nov. 28, 1983

[51] Int. Cl.[3] ..... A41D 13/08

[52] U.S. Cl. ..... 2/21; 2/163

[58] Field of Search ..... 2/21, 16, 22, 159, 161 R, 2/163

[56] References Cited

U.S. PATENT DOCUMENTS

| | | | |
|---|---|---|---|
| 293,831 | 2/1884 | Wickers | 2/21 |
| 1,174,887 | 3/1916 | Meriwether | 2/21 X |
| 1,268,103 | 6/1918 | Fleming | 2/21 |
| 1,316,292 | 9/1919 | Fleming | 2/21 |
| 1,337,957 | 4/1920 | Rasmussen | 2/21 |
| 1,388,618 | 8/1921 | Stein | 2/21 |
| 1,951,190 | 3/1934 | Gambee | 2/21 |
| 2,351,906 | 6/1944 | Beatty | 2/21 |
| 2,925,605 | 2/1960 | Wheeler | 2/21 |
| 3,331,083 | 7/1967 | Holly | 2/22 X |
| 4,257,596 | 3/1981 | Capella | 2/21 X |

*Primary Examiner*—Louis K. Rimrodt
*Assistant Examiner*—J. L. Kravitz

[57] ABSTRACT

A finger guard for protection against injury by a knife when cutting foodstuff. The finger guard extends along the back-hand face of an operator finger, and is bendable concurrently with the latter. The finger guard consists of a multiplicity of spaced-apart, interconnected lamellae, with a given upper lamella having a lower portion overlying the upper portion of the corresponding lower lamella; wherein should the blade of a knife hit the finger guard, that blade would subsequently slide downwardly successively from upper to lower lamellae in a frictionless fashion without injury to the finger. Two elongated flexible metal stems extends on each side of and pivotally interconnects with the lamellae. The stems can bend to follow the motion of the finger. An adjustable retaining strap surrounds the front hand face of the finger at an intermediate portion of the finger guard and a basket member, attached to the stems, receives the finger tip.

4 Claims, 8 Drawing Figures

Fig. 1
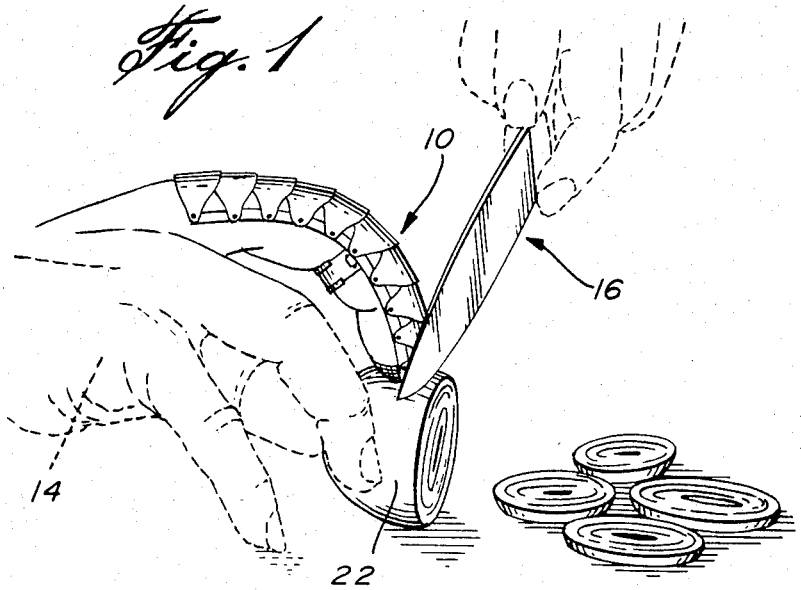
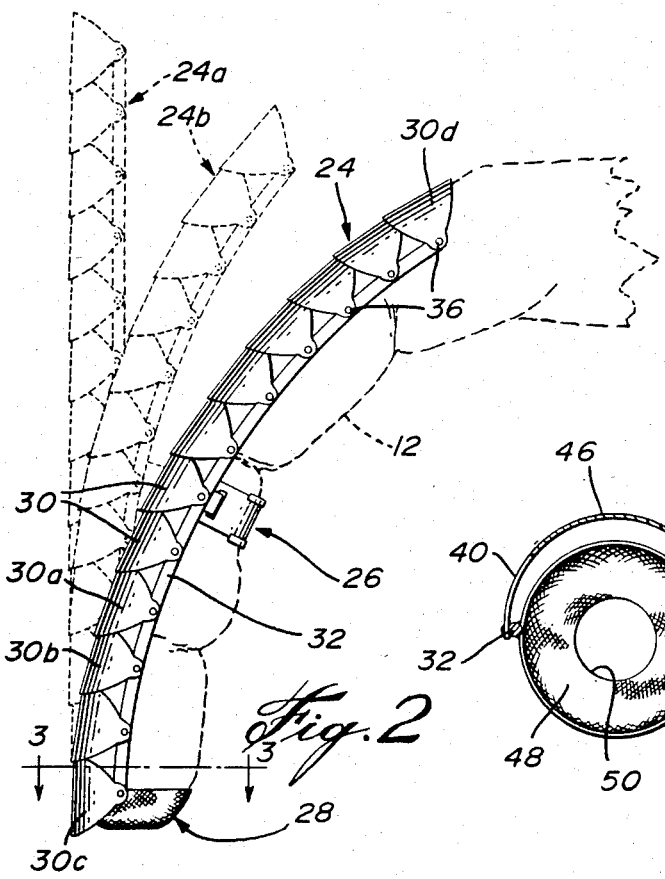
Fig. 2
Fig. 3
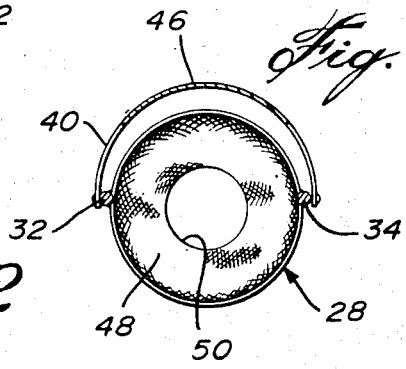

FINGER-GUARD

FIELD OF THE INVENTION

This invention relates to guard means for use upon a finger of an operator of dangerous machinery, or tool, and more specifically to a finger-guard for butchers and the like to protect at least the most exposed finger of the hand against injury as cuts from a misdirected knife.

BACKGROUND OF THE INVENTION

U.S. Pat. No. 1,951,190 dated Mar. 13, 1934, describes shielding the back hand face of all the user's fingers without shielding the front hand face. However, this device is heavy, cumbersome, and costly, and the feel of the meat or other foodstuff to be cut remains very limited.

A more flexible type of finger-guard was lacking, and which would be designed to protect only the most exposed finger of an operator's hand holding foodstuff being cut by a knife held by the other hand. For such a purpose, it has been found unnecessary to protect the remaining fingers.

OBJECTS OF THE INVENTION

The main object of the invention is to provide a finger-guard that is most flexible, very thorough in protecting a single finger from injury, and simple to manufacture together with a low production cost.

Another important object of the invention is to provide a finger-guard that is snugly but firmly retained on a single finger.

Still another object of the invention is to provide the finger-guard with means to properly feel the material to be worked on by the possibly injury-causing tool, without increasing the probabilities of an injury.

Other objects will be more apparent as the description proceeds taken in conjunction with the following drawings.

SUMMARY OF THE INVENTION

The finger-guard of the invention is to be used upon the most exposed finger of the hand of an operator, such as a cook cutting foodstuff. The finger-guard comprises a number of lamellae, extending along the length of a finger, and pivotally connected in spaced-apart relationship to a pair of lateral flexible stems. The lamellae are so arranged that a given upper lamella has its lower side overlying the upper side of the corresponding lower lamella. Hence, a knife hitting the finger-guard would slide from top to bottom without injuring the finger.

A centrally located retaining member is provided to adjustably hold the finger-guard onto the finger of the operator. A pocket member is also provided at the bottom of the finger-guard to receive the finger tip. A hole is made in the center of the pocket to ensure proper feel of the material to be worked on with the tool.

BRIEF DESCRIPTION OF THE DRAWINGS

FIG. 1 is a perspective view of the finger-guard of the invention, as inserted on the major finger of a cook in the process of cutting an egg;

FIG. 2 is a lateral view in elevation of the embodiment of FIG. 1, with the protected finger in dotted lines, and the bending pattern of the finger-guard shown in dashed outline;

FIG. 3 is a cross-sectional view of the invention, taken along line 3—3 of FIG. 2;

DETAILED DESCRIPTION OF THE DRAWINGS

Figure 4:
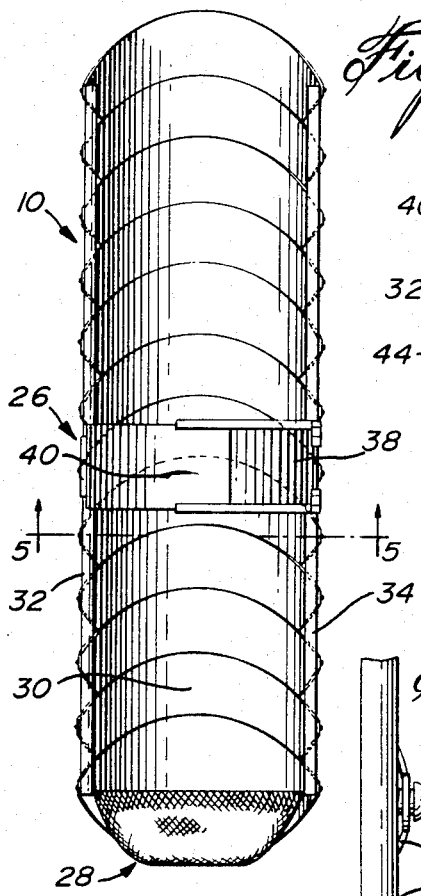
FIG. 4 is an elevation looking at the back.
Figure 5:
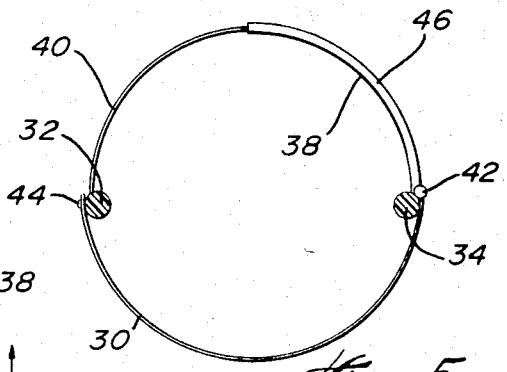
FIG. 5 is a cross-sectional view of the invention taken along line 5—5 of FIG. 3.
Figure 8:
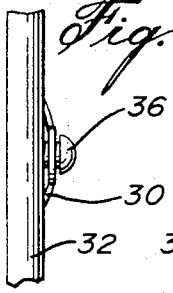
FIG. 8 is a lateral view of the arrangement of FIG. 7.
Figure 7:
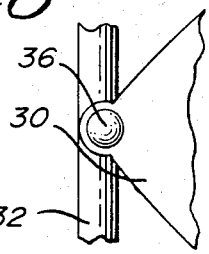
FIG. 7 is a partial elevation of the attachment of a lamella to one stem.

In the drawings, a preferred embodiment of the invention is shown, the finger-guard being referred to in FIGS. 1 and 4 by numeral 10. The finger-guard 10 is designed to be inserted on one finger 12 of the hand 14 of a person working with dangerous cutting articles such as a knife 16 or the like, the finger being the most exposed finger such as the major second finger. The finger-guard 10 is especially useful for cooks cutting slices of foodstuff 22 such as egg.

The finger-guard 10 of the invention is constituted of the three following parts: a finger-guard means 24, a centrally-located linking member 26 to connect the finger-guard means 24 to the finger 12, and finger-tip receiving means 28.

The finger-guard means 24 is bendable, to follow the bending of the finger 12, from a straight elevated position 24*a* to any of a variety of variably bent positions, such as position 24*b*.

The finger-guard means 24 is essentially made of two resilient metallic stems 32 and 34 and of a multiplicity of elongated somewhat ovoidal, spaced-apart lamellae 30 pivotally connected to the stems 32, 34 and adapted to extend all along the back-hand face of the finger 12. Each lamella is longitudinally curved into about half a circle to conform to the transverse curvature of the finger and to extend down to opposite sides of the finger. The portion of a given lamella 30, such as lamella 30*a*, engages the upper portion of the corresponding lower lamella 30*b*, in an overlying manner, wherein should the blade of a knife 16 hit the finger guard means 24, for example, uppermost lamella 30*d*, the blade would subsequently slide downwardly successively from upper to lower lamellae 30 in a smooth fashion and towards the finger-tip receiving means 28.

The two resilient, metallic, stems 32, 34, extend across opposite ends of the lamellae 30, and pivotally interconnect the latter in spaced-apart relationship by headed studs 36, each of which is fixed to stem 32 and 34 and extends through a hole made at the narrow end of a lamella. The stems 32, 34 extend along opposite sides of finger 12 when the finger-guard 10 is in operative position on finger 12. Stems 32, 34, when in unstressed condition, are longitudinally curved to conform to finger 12 when the latter is in bent condition, as shown in full lines in FIG. 2. Therefore, the stems 32, 34 serve to apply the lamellae 30 against the bent finger 12 and are straightened out by the lamellae when the finger 12 is unbent.

Figure 6:
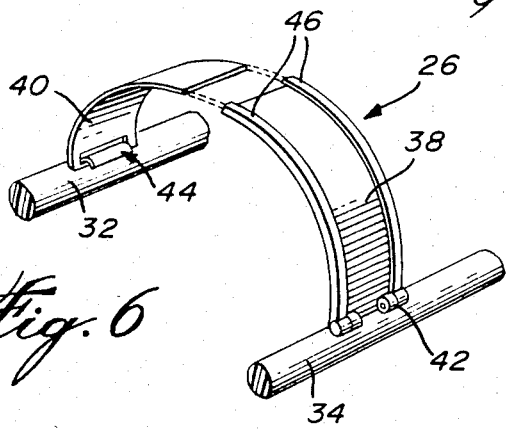
FIG. 6 is a perspective view of the linking member as connected to the two stems.

Referring now to FIG. 6, the linking member 26 is illustrated as comprising two longitudinally, elongated, metallic straps 38, 40, respectively connected to stems 32, 34, intermediate the ends thereof to produce a half-cylindrical shape. The two straps 38, 40, extend from stems 32, 34 opposite to lamellae 30 and are telescopically engageable one with the other. Strap 38 has outer rails 46 into which strap 40 may frictionally engage until the front hand face of finger 12 is tightly surrounded. Strap 38 is pivotally connected to stem 34 by hinging means 42, whereas strap 40 is pivotally connected to stem 32 by hinging means 44. The straps 38, 40, may be replaced by elastic bands, or even Velcro hook and pile type fastener connecting members.

As shown in FIG. 3, the receiving means 28 includes a cup-shaped screen pocket 48, connected by welding to the lower ends of stems 32, 34 and having a center bore 50 for receiving the tip of finger 12. The lowermost lamella 30*c* (see FIG. 2) overlaps pocket 48. The bore 50 helps in two ways: it increases the clinging to finger 12, together with a better feel and handling of foodstuff 22. The finger-guard is held on one finger without the need of cords or straps connected to the user's wrist. Therefore hand movement remains free.

What I claim is:

1. A finger-guard for protection against injuries by a knife or the like tool, comprising: two resilient stems adapted to extend along opposite sides of an operator finger, a multiplicity of spaced-apart, elongated lamellae, each longitudinally curved into about half a circle, extending transversely of said stems and having their ends pivotally connected to the two stems, said lamellae adapted to extend along the back hand face of the operator finger with a given upper lamella having a lower portion overlying the upper portion of the corresponding lower lamella, whereby should the blade of a knife hit the lamellae, the blade will slide downwardly successively from upper to lower lamellae in a smooth fashion, said stems longitudinally curved, and, when in non-stressed condition, applying said lamellae against a bent operator finger, said stems being straighthened out by said lamellae when said finger is unbent, and strap means attached to said stems at an intermediate portion thereof and extending from said stems in a direction opposite said lamellae to surround the front hand face of the finger and to retain said lamellae and stems on said finger.

2. The finger-guard of claim 1, further including a fingertip receiving pocket secured to the lower ends of said stems and having a bore in the center; wherein said pocket protects the finger free end from injury but at the same time allows the operator to retain a feel of the material worked on with said tool.

3. The finger-guard of claim 1, wherein said strap means comprises two elongated, longitudinally curved straps hinged on the respective stems; said straps being telescopically engageable with a friction fit.

4. The finger-guard of claim 2, wherein said strap means comprises two elongated, longitudinally curved straps being hinged on the respective stems; said straps telescopically engageable with a friction fit.

* * * * *